United States Patent [19]

Kuhar

[11] 4,365,567

[45] Dec. 28, 1982

[54] MODIFIED THREAD CONTROL LEVER FOR A BOBBIN CASE

[75] Inventor: Ludwig J. Kuhar, Clark, N.J.

[73] Assignee: The Singer Company, Stamford, Conn.

[21] Appl. No.: 921,033

[22] Filed: Jun. 30, 1978

[51] Int. Cl.[3] ..... D05B 57/14; D05B 59/00

[52] U.S. Cl. ..... 112/184; 112/229

[58] Field of Search ..... 112/229, 231, 184

[56] References Cited

U.S. PATENT DOCUMENTS

| | | | |
|---|---|---|---|
| 3,138,127 | 6/1964 | Ketterer | 112/184 |
| 3,154,035 | 10/1964 | Edwards et al. | 112/184 |
| 3,303,802 | 2/1967 | Crawford | 112/184 |
| 3,568,616 | 3/1971 | Coulombe | 112/229 |
| 4,100,866 | 7/1978 | Philips | 112/231 |

FOREIGN PATENT DOCUMENTS

| | | | |
|---|---|---|---|
| 1204096 | 9/1970 | United Kingdom | 112/229 |

*Primary Examiner*—W. C. Reynolds

*Attorney, Agent, or Firm*—Robert E. Smith; Edward L. Bell

[57] ABSTRACT

A bobbin case for a lockstitch sewing machine is disclosed which contains a thread control lever so constructed to allow the bobbin to be manually threaded from any direction without incurring the possibility of snagging the bobbin thread between the wall of the bobbin case and the thread control lever. One extremity of the thread control lever is pivotally mounted in a race formed in the wall of the bobbin case. The free extremity of the thread control lever, which is spring biased toward the bobbin, is shaped to form an obtuse angle with the wall of the bobbin case. Bobbin thread is thereby prevented from snagging between the bobbin case wall and the thread control lever.

3 Claims, 6 Drawing Figures

MODIFIED THREAD CONTROL LEVER FOR A BOBBIN CASE

BACKGROUND OF THE INVENTION

1. Field of the Invention

This invention relates to sewing machines in general and more particularly to sewing machines having mechanisms to replenish the bobbin thread supply while the bobbin remains in place within the loop taker.

2. Description of the Prior Art

One form of prior known bobbin case included a thread control lever which prevented spillage of thread from the bobbin and which simultaneously placed a drag on the rotation of the bobbin case as the bobbin became filled. One problem associated with the prior known thread control lever is that it is susceptible to snagging and breaking the bobbin thread. Another problem is that the loop seizing beak of the loop taker rotates in a direction opposite that in which the thread control lever projects, thereby increasing the susceptibility of snagging the bobbin thread between a projection of the thread control lever and the wall of the bobbin case.

SUMMARY OF THE INVENTION

It is an object of this invention to provide a bobbin case for a lockstitch sewing machine that is manually threadable from any direction.

It is another object of this invention to provide a bobbin case having a thread control lever which is immune to snagging bobbin thread when a bobbin is replaced within the bobbin case.

The disclosed objects and other advantages of this invention are achieved by providing a bobbin case with a race formed in its wall in which partially resides a bobbin thread control lever having one extremity pivotally fastened to the bobbin case. The other extremity of the bobbin thread control lever has formed thereon a thread engaging shoe which is spring biased toward the bobbin and which acts to contain the wraps of thread placed on the bobbin as the bobbin becomes filled with thread during the bobbin refilling process. The extremity of the bobbin thread control lever containing the thread engaging shoe is tapered to form an obtuse angle with the wall of the bobbin case, thereby preventing thread from being trapped between the wall of the bobbin case and the thread control lever when a bobbin containing thread is manually placed within the bobbin case. The race formed in the wall of the bobbin case also partially shelters the free extremity of the bobbin thread control lever, thereby affording additional protection against the snagging of bobbin thread.

BRIEF DESCRIPTION OF THE DRAWINGS

The above and other objects of this invention will become evident from an understanding of the preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 2:
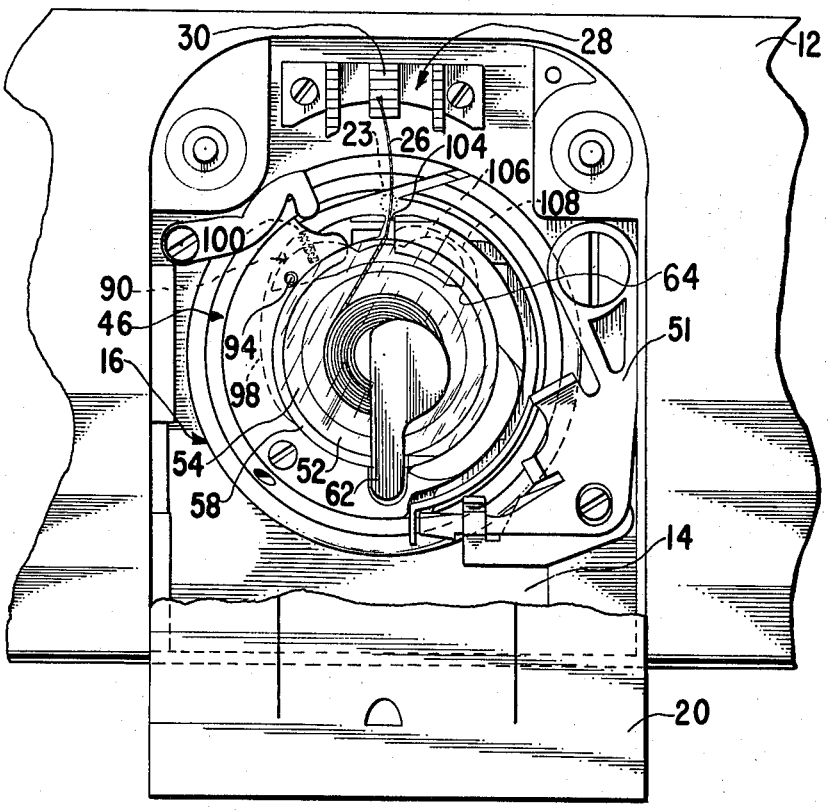
FIG. 2 is a top plan view showing the loop taker contained within the bed of a sewing machine.

Referring to the drawings, the invention is shown applied to a sewing machine of the type having a provision for rewinding thread on the bobbin while the bobbin remains in the loop taker. The construction and operation of such a bobbin rewinder is fully described in the U.S. Pat. No. 3,138,127 of June 23, 1964 to Ketterer, which is owned by the assignee of this invention.

Figure 1:
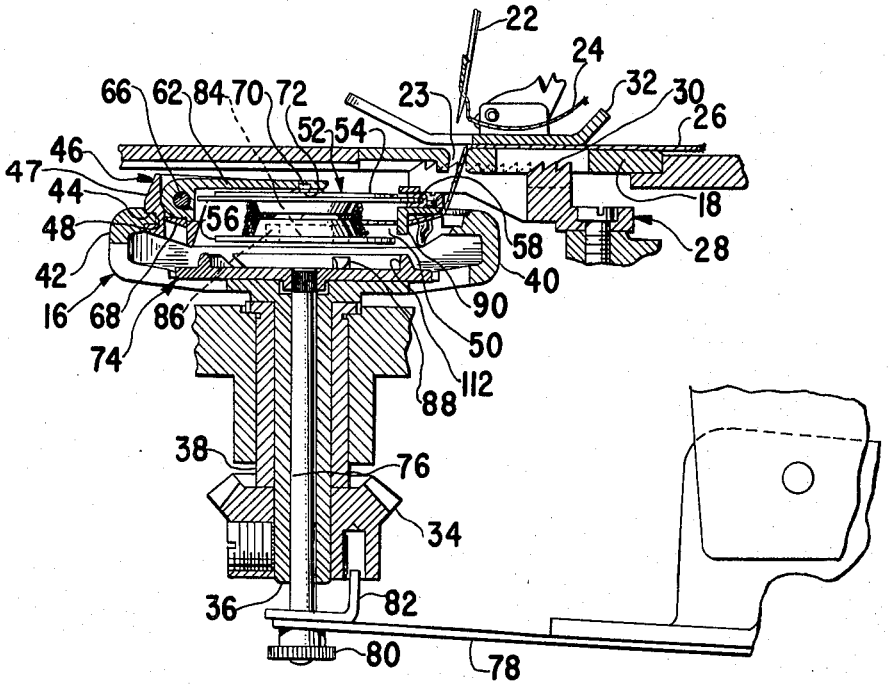
FIG. 1 is a vertical cross sectional view of the loop taker of a sewing machine having a bobbin thread control lever constructed in accordance with the teachings of this invention applied thereto.

FIG. 2 best illustrates a bed 12 of a sewing machine having a cavity 14 formed therein in which resides a loop taker shown generally at 16. The cavity 14 is enclosed by a throat plate 18 and a bed slide plate 20. FIG. 1 shows a needle 22 which reciprocates through an aperture 23 formed in the throat plate 18 and which carries with it a needle thread 24 which is concatenated with a bobbin thread 26 by the loop taker 16 to produce a lockstitch in a well known manner. A fabric to be sewn is moved past the needle 22 by a feed dog 28 which has a set of serrated teeth 30 and which rises through the throat plate 18 to cooperate with a presser foot 32 in a well known manner. The loop taker 16 is rotated in timed relation to the reciprocation of the needle 22 by a bevel gear 34 which drives a hollow vertical shaft 36 restrained in a bushing 38 which is journalled in the bed 12 of the sewing machine.

The loop taker 16 is formed with a cup-shaped body portion 40 having a wall 42 with an inner surface on which is formed an annular bearing rib 44. A bobbin case 46 having a wall 47 defining its periphery includes an annular raceway 48 which engages the annular rib 44 of the loop taker 16. The bobbin case 46 is restrained from rotation within a cavity 50 formed in the loop taker 16 by a bifurcated rotation restraining member 51 carried in the bed 12.

A thread carrying bobbin 52 having a circular upper flange 54 and a circular lower flange 56 whose diameter is smaller than the diameter of the upper flange 54 is supported within the bobbin case 46 by its upper flange 54 resting on a platform 58 formed in the bobbin case 46. The upper flange 54 of the bobbin 52 is connected to the lower flange 56 by a core 60. The bobbin 52 is constrained within the bobbin case 46 by an arm 62 which is pivotally journalled at one extremity to a wall 64 of the bobbin case 46 by a pin 66. A leaf spring 68 acts against the arm 62 to bias the distant extremity of the arm 62 against the bobbin 52. The distant extremity of the arm 62 has a depending ball 70 formed thereon which engages a depression 72 formed in the top flange 54 of the bobbin 52 to restrain the bobbin 52 within the bobbin case 46.

The mechanism described in this invention may be applied to a bobbin replenishment mechanism whose construction and operation is described in the aforementioned U.S. Pat. No. 3,138,127 of June 23, 1964 to Ketterer. The bobbin replenishment mechanism is more specifically constructed to include a bobbin winding member 74 which resides within the cup-shaped body portion 40 of the loop taker 16 and below the lower flange 56 of the bobbin 52. The bobbin winding member 74 is fastened to a rod 76 which freely resides within the hollow loop taker shaft 36. The rod 76 is rotatably fastened to a lever 78 by a fastener 80. The lever 78 may be arcuately rotated to elevate the rod 76 and the bobbin winding member 74 attached thereto in a manner which is more fully described in the aforementioned Ketterer patent. The lower extremity of the rod 76 has a pin member 82 rigidly fastened thereto, which engages the bevel gear 34 to impart a turning motion to the rod 76. The lower flange 56 of the bobbin 52 has an annular groove 84 formed therein in which is contained a depending wedge 86 which may be engaged by a pin 88 formed on the surface of the bobbin winding member 74 when the bobbin winding member 74 is elevated by the rod 76. The bobbin winding member 74 is engaged against the bobbin 52 and is rotatably driven with the loop taker 16 by the bevel gear 34. The bobbin 52 may thereby be replenished with bobbin thread 26 which will be consumed in the formation of lockstitches. The bobbin winding member 74 may be disengaged from contact with the bobbin 52 by arcuately rotating the lever 78 downwardly, thereby causing the rod 76 to move downward and lower the pin 88 of the bobbin winding mechanism 74 away from engagement with the depending wedge 86 formed on the lower flange 56 of the bobbin 52.

Figure 4:
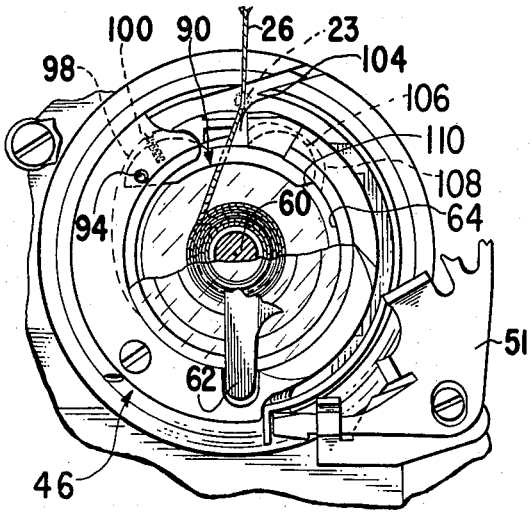
FIG. 4 is a top plan view of a loop taker showing the path taken by the bobbin thread as it exits the bobbin case.
Figure 3:
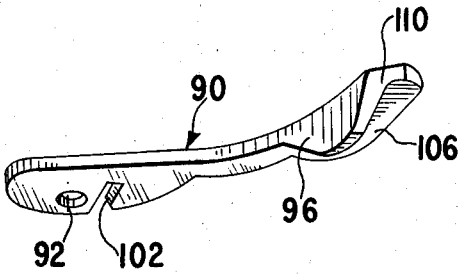
FIG. 3 is a perspective view of a bobbin thread control lever constructed in accordance with the teachings of this invention.

A bobbin thread control lever 90 which is contained within the bobbin case 46 is shown in FIG. 3. The lever 90 has a bore 92 formed at one extremity thereof for receiving a pivot pin 94. The other extremity has a thread engaging shoe 96 which is arcuately shaped to engage wraps of bobbin thread 26 contained on the bobbin core 60. The bobbin case 46 has a race 98 formed in the wall 64 thereof in which the pivoted extremity of the thread control lever 90 is retained with the pivot pin 94. The extremity of the thread control lever 90 which contains the thread engaging shoe 96 is biased away from the wall 64 of the bobbin case 46 by a spring 100 which resides in a slot 102 formed in the thread control lever 90. The thread control lever 90 extends across a gap 104 formed in the wall 64 of the bobbin case. A flange 106 extends from the thread control lever 90 away from the thread engaging shoe 96 and resides within a race extension 108 contained in the wall 64 of the bobbin case 46. The free extremity of the thread control lever 90 has formed thereon an oblique surface 110. FIG. 4 shows that the oblique surface 110 forms an obtuse angle with the wall 64 of the bobbin case 46, and that the most distant intersection of the flange 106 with the oblique surface 110 of the thread control lever 90 is always sheltered by the race extension 108, irrespective of the position of the thread control lever 90.

The thread control lever 90 cooperates with the bobbin winder mechanism during the bobbin thread replenishment process to prevent the bobbin 52 from being overfilled with bobbin thread 26. The bobbin winder mechanism is engaged by arcuately rotating the lever 78 upwardly in a manner which need not be recited for a full understanding of the present invention. The arcuate upwardly rotation of the lever 78 causes the rod 76 to move upwardly through the loop taker shaft 36 and elevate the pin 88 contained on the bobbin winding member 74 against the depending wedge 86 contained within the annular groove 84 formed on the lower flange 56 of the bobbin 52. The rotation of the bevel gear 34 thereafter imparts a turning motion to the bobbin 52 through the pin 88 which is carried on the bobbin winding member 74 and which is attached to the rod 76. As the bobbin 52 rotates, it withdraws thread from the needle thread supply in a manner more fully described in the aforementioned patent to Ketterer.

It will be apparent from FIGS. 1 and 2 that as thread is wound around the bobbin core 60 the outer wraps of thread will begin to approach the circumference of the lower flange 56 of the bobbin 52. The wraps of thread which are placed on the bobbin 52 will begin to engage the surface of the thread engaging shoe 96 of the thread control lever 90 as the bobbin 52 is filled, due to the location of the thread engaging shoe 96 with respect to the outer edge of the lower flange 56 of the bobbin 52. When the wraps of thread wound around the bobbin core 60 engage the thread engaging shoe 96, the back surface of the thread engaging shoe 96 will engage an annular rib 112 of the bobbin winding member 74. As the bobbin 52 continues to fill with thread, the drag imposed on the annular rib 112 by the thread engaging shoe 96 will increase, and will cause the speed of the sewing machine drive motor to decrease. The decreasing speed will act to warn the sewing machine operator to terminate the bobbin thread replenishing operation. The operation may alternatively be terminated automatically by a mechanism such as that more fully described in the aforementioned patent to Ketterer.

Once a bobbin 52 has been replenished with thread it may be removed from the sewing machine by arcuately rotating upwardly the arm 62 and lifting out the bobbin 52. The bobbin 52 will thereafter be available for sewing when the size and color thread with which it has been filled is required by the sewing machine operator. It will be appreciated by one familiar with the art of sewing that it is advantageous to retain several bobbins, each filled with thread of a particular size and color, for ready availability should they be needed during a sewing project. It will therefore be evident that a normal operation during the sewing process will involve replacing a bobbin. To that end, the thread control lever 90 will insure that the thread 26 of the refilled bobbin does not snag between the thread control lever 90 and the wall of the bobbin case 64.

A bobbin which has previously been refilled with thread may be placed in the bobbin case 46 by arcuately rotating upwardly the arm 62 and placing the bobbin 52 into the exposed cavity within the bobbin case 46. The arm 62 is thereafter arcuately rotated downwardly causing the depending ball 70 to engage the depression 72 in the bobbin 52. The bobbin thread 26 will thereafter rest on top of the thread control lever 90 as shown in FIG. 5 with its free extremity leading toward the aperture 23 where it will be available to be concatenated with the needle thread 24 in the formation of lockstitches.

Figure 5:
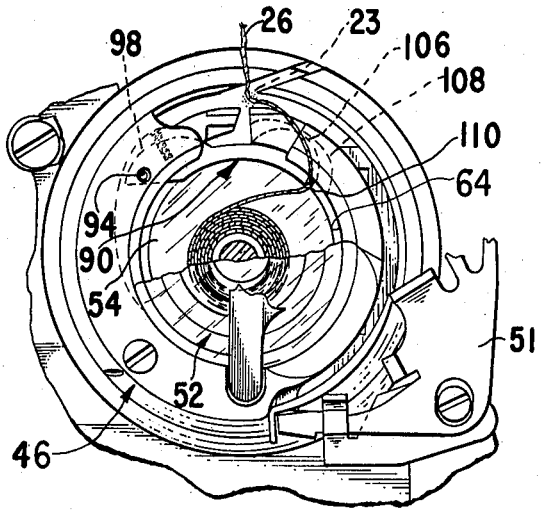
FIG. 5 is a top plan view similar to FIG. 4 showing how the bobbin thread control lever of this invention prevents the snagging of the bobbin thread.

FIG. 5 shows that the thread 26 may not lead directly from the bobbin 52 to the aperture 23, in which instance it is possible for the thread to contact the extremity of the thread control lever 90 which contains the oblique surface 110. Since the oblique surface 110 of the thread control lever 90 forms an obtuse angle with the wall 64 of the bobbin case 42, it will be apparent that the bobbin thread 26 will not be trapped between the free extremity of the thread control lever 90 and the wall 64 of the bobbin case 46 and will, therefore, be less susceptible to being severed during the sewing process.

Figure 6:
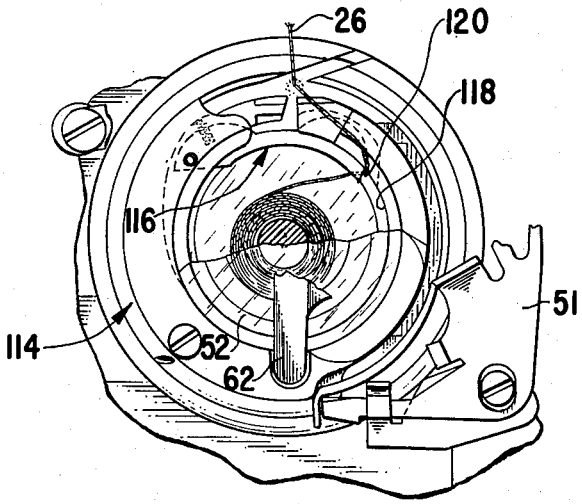
FIG. 6 PRIOR ART
FIG. 6 is a top plan view similar to FIG. 5 showing the susceptibility of a prior known bobbin thread control lever to snagging the bobbin thread.

FIG. 6 shows a bobbin case 114 having a prior art thread control lever 116 which does not incorporate the teachings of the present invention. It will be appreciated that the bobbin thread 26 has become trapped between the free extremity of the thread control lever 116 and a wall 118 of the bobbin case 114 and may be severed by the further withdrawal of bobbin thread 26 from the bobbin 52, thereby disrupting the manual threading process.

Modifications and variation, of the above described preferred embodiment may become evident to one skilled in the art in light of the above teachings. It is to be understood that variations may be made to the preferred embodiment without departing from the spirit and scope of the invention as defined in the appended claims.

Having thus set forth the nature of the invention, what is claimed herein is:

1. A bobbin case for a lockstitch sewing machine having stitch forming instrumentalities including a needle and a loop taker, actuating means interconnecting said needle and loop taker for interrelated movement as is required for the formation of lock stitches, a bobbin case, said loop taker having a cavity formed therein for receiving said bobbin case, means for restraining said bobbin case from rotation with said loop taker, said loop taker having a wall defining its periphery and containing a bearing rib formed along an inner surface of said wall, said bobbin case having a wall defining its periphery, said bobbin case wall containing an annular raceway, said bearing rib of said loop taker being received by said annular raceway of said bobbin case for supporting said bobbin case within said cavity of said loop taker, a gap formed in said wall of said bobbin case, a thread control lever bridging said gap in said wall, said wall of said bobbin case further having a race and a race extension formed therein, said race pivotally receiving one extremity of said thread control lever for arcuate motion toward and away from said wall of said bobbin case, said thread control lever having an arcuately formed thread engaging shoe at an extremity opposite the pivoted extremity for engaging wraps of thread contained on said bobbin, and an oblique surface at the thread engaging shoe extremity of said thread control lever, said oblique surface forming an obtuse angle with said wall of said bobbin case, whereby a bobbin containing a supply of bobbin thread may reside in said bobbin case with said bobbin thread passing over said thread control lever to a point where a lockstitch is formed.

2. The arrangement as set forth in claim 1 wherein the extremity of said thread control lever having said thread engaging shoe is biased away from said bobbin case wall by a spring.

3. The arrangement as set forth in claim 1 wherein said thread control lever has a flange formed at the extremity thereof containing said thread engaging shoe, said flange partially residing within said race extension formed within along said inside wall of said bobbin case.

* * * * *